US005325697A

United States Patent [19]

Shore et al.

[11] Patent Number: 5,325,697

[45] Date of Patent: Jul. 5, 1994

[54] METHOD AND APPARATUS FOR CONTINUOUSLY HOT ROLLING FERROUS LONG PRODUCTS

[75] Inventors: Terence M. Shore, Princeton; Harold E. Woodrow, Northboro; Melicher Puchovsky, Dudley, all of Mass.

[73] Assignee: Morgan Construction Company, Worcester, Mass.

[21] Appl. No.: 84,083

[22] Filed: Jun. 28, 1993

Related U.S. Application Data

[63] Continuation of Ser. No. 860,257, Mar. 31, 1992, abandoned, which is a continuation-in-part of Ser. No. 696,206, May 6, 1991, abandoned.

[51] Int. Cl.[5] ..... B21B 1/00; B21B 35/02

[52] U.S. Cl. ..... 72/234; 72/249; 72/366.2

[58] Field of Search ..... 72/226, 228, 234, 235, 72/365.2, 366.2, 249

[56] References Cited

U.S. PATENT DOCUMENTS

| | | | |
|---|---|---|---|
| Re. 28,107 | 8/1974 | Wilson et al. | 72/235 |
| 3,043,170 | 7/1962 | Wales | 72/235 |
| 3,486,359 | 12/1969 | Hein | 72/200 |
| 3,595,055 | 7/1971 | Rohde | 72/226 |
| 3,683,662 | 8/1972 | Dechene et al. | 72/235 |
| 3,914,973 | 10/1975 | Koch et al. | 72/235 |
| 3,992,915 | 11/1976 | Hermes et al. | 72/249 |
| 4,024,746 | 5/1977 | Brück | 72/249 |
| 4,192,164 | 3/1980 | Brauer | 72/234 |
| 4,347,725 | 9/1982 | Demny | 72/249 |
| 4,537,055 | 8/1985 | Woodrow et al. | 72/235 |
| 4,577,529 | 3/1986 | Romi | 74/665 GA |
| 4,840,051 | 6/1989 | Boratto et al. | 72/366.2 |
| 4,907,438 | 3/1990 | Sasaki et al. | 72/235 |

FOREIGN PATENT DOCUMENTS

| | | | |
|---|---|---|---|
| 0466437 | 7/1950 | Canada | 72/365.2 |
| 0358917 | 3/1990 | European Pat. Off. . | |
| 2722934 | 12/1978 | Fed. Rep. of Germany . | |
| 3039101 | 5/1982 | Fed. Rep. of Germany . | |
| 60-24724 | 6/1985 | Japan . | |
| 1458046 | 2/1989 | U.S.S.R. | 72/365.2 |
| 2075390 | 11/1981 | United Kingdom | 72/365.2 |
| 2168280 | 6/1986 | United Kingdom | 72/234 |

OTHER PUBLICATIONS

Backofen, Walter A., *Deformation Processing*, Addison-Wesley Publishing Co., (Reading, Mass.), 1972, pp. 276–283.

*Primary Examiner*—Lowell A. Larson

*Attorney, Agent, or Firm*—Samuels, Gauthier & Stevens

[57] ABSTRACT

Long products are hot rolled and sized by being subjected to progressively diminishing area reductions in a succession of at least three mechanically interconnected two roll passes driven by a common mill drive. The area reductions are achieved by imparting a first cross sectional configuration to the products rolled in the first roll pass, and by imparting a different second cross sectional configuration to the products being rolled in each of the second and third roll passes. A wide range of product sizes is accommodated by selectively adjusting the speeds at which each of the roll passes is driven by the common mill drive in order to vary the drive speed ratios between successive roll passes.

15 Claims, 7 Drawing Sheets

METHOD AND APPARATUS FOR CONTINUOUSLY HOT ROLLING FERROUS LONG PRODUCTS

This is a continuation of application Ser. No. 07/860,257 filed on Mar. 31, 1992, now abandoned, which is a continuation-in-part of U.S. application Ser. No. 07/696,206 filed May 6, 1991, now abandoned.

BACKGROUND OF THE INVENTION

1. Field of the Invention

This invention relates generally to the rolling of long products, and is concerned in particular with an improved method and apparatus for continuously hot rolling ferrous rods and bars.

2. Description of the Prior Art

In the conventional steel rod rolling mill, as depicted schematically in FIG. 1, a plurality of roll stands S1–S27 are aligned along a rolling line to continuously roll billets received from a furnace 10 or other like source. The roll stands are arranged in successive groups which typically include a roughing group 12, an intermediate group 14 and a finishing group 16. The roll stands of the roughing and intermediate groups are usually individually driven, and are arranged alternately with horizontal and vertical work rolls, or in some cases with housings that can be adjusted to achieve either horizontal or vertical work roll configurations.

The roll stands of the finishing group 16 are usually mechanically connected to each other and to a common drive to provide an arrangement referred to as a "block" (illustrated diagrammatically at 18 in FIG. 1). U.S. Pat. Nos. Re.28,107 and 4,537 055 provide illustrative examples of blocks well known and widely employed throughout the metals industry. The mill rolling schedule will usually be based on an oval-round pass sequence, with guides being arranged between the roll stands to direct the product from one roll pass to the next along the rolling line.

Modern mills of the above-described type must have the capability of meeting diverse and increasingly demanding customer requirements, not the least important of which is the ability to supply a wide range of product sizes. For example, a rod mill should ideally be capable of supplying round rods ranging from about 3.5 to 25.5 mm in diameter.

When changing from one product size to another, the mill must be shut down in order to afford operating personnel an opportunity to make the necessary adjustments to the rolling equipment. Such adjustments include changing work rolls and guides, rendering selected stands inoperative by either removing them from the rolling line or removing their work rolls (a practice commonly referred to as "dummying"), etc.

The duration and frequency of such shutdowns can have a severe negative impact on overall mill utilization. For example, in the conventional mill illustrated in FIG. 1, even when making a relatively modest change from rolling a family of products having as its smallest size a 5.5 mm diameter round to another family of products having as its smallest size a 6.0 mm round, the work rolls of the roll passes in stands S12 to S19 of the intermediate mill 14 and all of the work rolls in stands S20 to S27 of the block 18 must be changed. In addition, most if not all of the guides between stands S12 to S29 also must be changed. This can take up to an hour to complete, at a significant loss in production time and profit to the mill owner.

Because of this, mill operators are reluctant to frequently make major changes to product sizes, preferring instead to roll the same or closely related sizes within the same family for protracted periods. This not only increases product storage requirements and inventory costs, but also fails to provide the flexibility often needed to meet customer requirements. The need to store a wide variety of work rolls and guides further exacerbates inventory costs.

There is also a growing demand to have products "sized", i.e., finish rolled to extremely close tolerances on the order of those approaching cold drawn tolerances. The tolerances achieved through sizing enable products to be employed "as rolled", i.e., without having to be additionally subjected to expensive machining operations such as "peeling" or "broaching". Such high tolerance products are required, for example, in the manufacture of bearing cages, automotive valve springs, etc. Also, depending on the type of steel being processed and the intended end use of the product, the customer may further require that finish rolling be carried out at temperatures at or about the $A_3$ temperature (a process which can be classified as "thermomechanical rolling"). Thermomechanically rolled products rolled below the recrystalization temperature retain a flattened or "pancaked" fine grain structure which increases tensile strength while at the same time shortening the time required for subsequent heat treatments, e.g., spheroidized annealing.

In the conventional sizing operation, the product exiting from the last stand of the finishing group 18 is subjected to further rolling in so-called "sizing" stands. The sizing stands achieve the desired close tolerances by affecting relatively light reductions in a round-round pass sequence. A recent development in sizing technology as it relates to larger diameter bar products is disclosed in U.S. Pat. No 4,907,438 issued Mar. 13 1990 to Sasaki et al. Here, the sizing stands are grouped in block form at a location downstream from the delivery end of the finishing section of a bar mill. The sizing stands have fixed interstand drive speed ratios and a round-round pass sequence adapted to take relatively light reductions on the order of 8.7–13.5%. By changing groove configurations and/or roll partings in the roll stands of the sizing mill, and by dummying out selected upstream roll stands in the intermediate and/or finishing mill sections, it is theoretically possible to produce an incremental range of finished product sizes, thereby improving operating efficiency and mill utilization.

However, experience has indicated that such improvements may be offset and in some cases put entirely out of reach by the development in certain products of a duplex microstructure, where the grains throughout the cross-section of the product vary in size by more than about 2 ASTM grain size numbers*. This phenomenon, commonly referred to as "abnormal grain growth", is particularly pronounced in medium carbon and case hardening steel grades.

* Measured in accordance with ASTM E112-84.

It is generally recognized that a variation of more than about 2 ASTM grain size numbers in the cross-section of a product can cause rupturing and surface tearing when the product is subjected to subsequent cold drawing operations. Such grain size variations also contribute to poor annealed properties, which in turn adversely affect cold deformation processes.

It has now been determined that abnormal grain growth can occur as a result of the time interval which conventionally occurs between the last significant reduction which takes place during normal rolling and the lighter reductions which take place during sizing.

More particularly, in the roll stands of the roughing, intermediate and finishing groups, the product is subjected to relatively high levels of successive reductions on the order of 15 to 30%. Each such reduction produces an increased energy level in the product sufficient to create a substantially uniform distribution of fine grains. Depending on time, temperature and chemical composition, after each sequential reduction the internal energy produced by deformation instantly begins to dissipate by recovery, recrystallization and grain growth. At each successive significant reduction, the increased internal energy state is reestablished, which again refines the microstructure. Thus, as the product proceeds through the mill and is rapidly subjected to relatively high levels of successive reductions, it retains a substantially uniform fine grained microstructure.

However, after the last significant reduction, grain growth again commences. The extent to which grain growth continues is directly dependent on time, temperature and the chemical composition of the steel being rolled. The relatively light reductions which are taken subsequently in the sizing stands are insufficient to affect the entire microstructure of the product, since only grains at the product surface are deformed.

Thus, unless sizing occurs sufficiently soon after the last significant mill reduction, the intervening unabated grain growth coupled with only localized surface grain deformation during sizing will produce an unacceptable dual grain microstructure, with the size of grains varying significantly throughout the cross-section of the product.

This phenomenon is further illustrated in FIGS. 2A and 2B. FIG. 2A includes photomicrographs (X150) showing the grain structure at selected locations in the cross-section of a 12.5 mm rod, steel grade 1040, with uniform grain structure prior to sizing. FIG. 2B includes photomicrographs at the same magnification of the same rod after it has been subjected to a 7.6% reduction in two round sizing passes. The resulting duplex microstructure is plainly evident.

As the rolling schedule changes and stands are progressively dummied back through the finishing and intermediate sections of the mill in order to feed the sizing stands with progressively larger products, the time interval between the last significant reduction and the commencement of sizing increases, thereby exacerbating the abnormal grain growth problem.

Some attempts have been made at eliminating duplex microstructures by taking higher reductions in the round passes of the sizing stands. While this practice does yield more uniform microstructures, it does so at the cost of poorer tolerances and a marked decrease in the ability of the mill to roll a range of product sizes without changing roll grooves (a practice commonly referred to as "free size rolling").

The fixed interstand drive speed ratios of conventional sizing stands also seriously limit the possibility of combining sizing with other operations, e.g., thermomechanical rolling.

SUMMARY OF THE INVENTION

A major objective of the present invention is to provide a method and apparatus for sizing a wide range of product sizes, while avoiding abnormal grain growth leading to a duplex microstructure in the finished product.

A companion objective of the present invention is to provide the ability to combine sizing with other operations, for example lower temperature thermomechanical rolling, again over a wide range of product sizes, without abnormal grain growth in the finished product.

A related objective of the present invention is to minimize the changes required to the rolling schedule and operation of the mill when shifting from one product size to another, thereby enhancing mill utilization.

The present invention achieves these and other objectives and advantages by employing a "post finishing" block of roll stands downstream from the finishing stands of the mill. Water boxes or other like cooling devices are preferably interposed between the last mill finishing stand and the postfinishing block. The post finishing block includes at least two reduction stands followed by at least two sizing stands. Preferably, the reduction stands have an oval-round pass sequence, and the sizing stands have a round-round pass sequence. Although the roll stands of the post finishing block are mechanically interconnected to each other and to a common drive, clutches or other equivalent means are employed in the drive train to permit changes to be made between the interstand drive speed ratios of at least the reduction stands, and preferably also between some or all of the remaining sizing stands. A fixed rolling schedule is provided for all roll stands in advance of the finishing stands. Thus, the finishing group is supplied with a first process section having a substantially constant cross sectional area and configuration. The first process section is passed through the finishing group and rolling occurs in either none, some, or all of the finishing roll stands, depending on the size of the desired end product. The product then continues through water cooling boxes to the post finishing block as a second process section. The interstand drive speed ratios of the roll stands in the post finishing block are appropriately adjusted to accommodate rolling of the second process section. The total reductions affected in the initial reduction stands of the post finishing block are well above 14%, thereby producing an increased energy level in the product sufficient to create a substantially uniform distribution of fine grains. Typically, such total initial reductions will be on the order of about 20–50%. Significantly lighter reductions on the order of 2–15% are taken in the final round-round pass sequences of the post finishing block to obtain the desired close sizing tolerances in the finished product. The time interval between the higher reductions affected in the oval-round pass sequence and the lighter reductions affected during sizing in the round-round pass sequence is such that the resulting grain size throughout the product cross section will not vary by more than 2, and in most cases by less than 1 ASTM grain size number.

DETAILED DESCRIPTION OF PREFERRED EMBODIMENT

Figure 1:
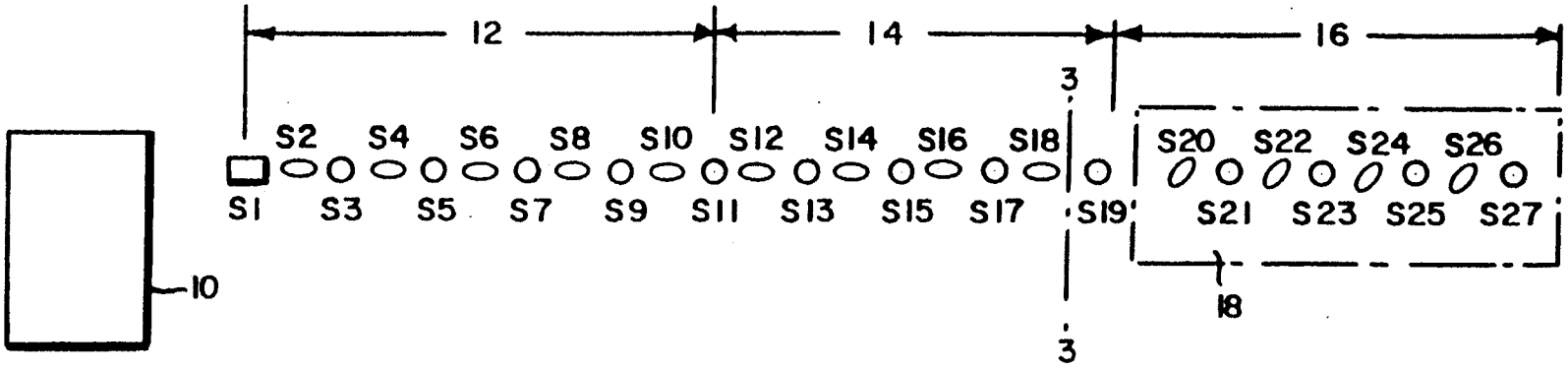
FIG. 1 is a schematic view depicting the changes in cross section of a product being rolled through the successive roll stands of a conventional high speed rod mill.
Figure 3:
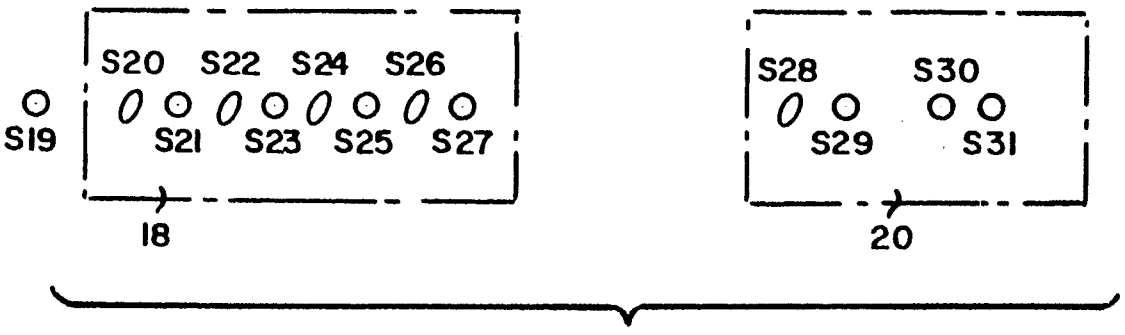
FIG. 3 is a schematic view beginning at reference line 3—3 in FIG. 1 and depicting the changes in cross section of a product rolled in accordance with the present invention.
Figure 2A:
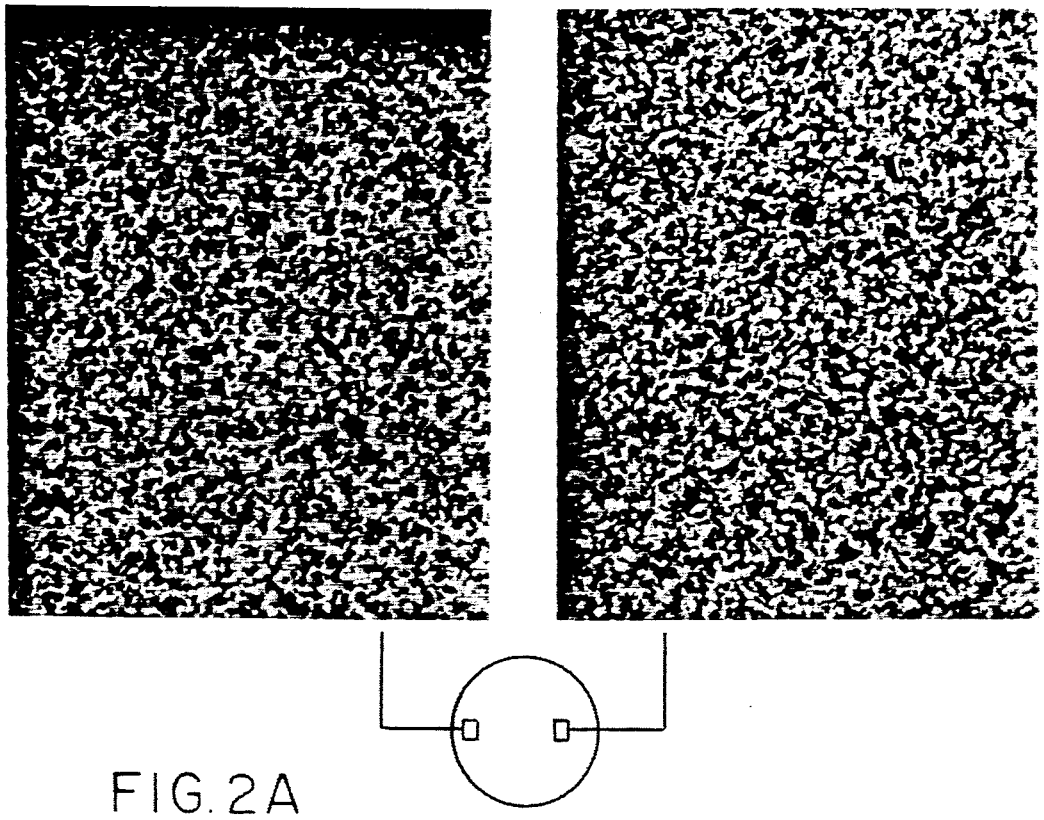
FIGS. 2A and 2B respectively includes photomicrographs of a product's grain structure before and after sizing, with resultant abnormal grain growth.
Figure 2B:
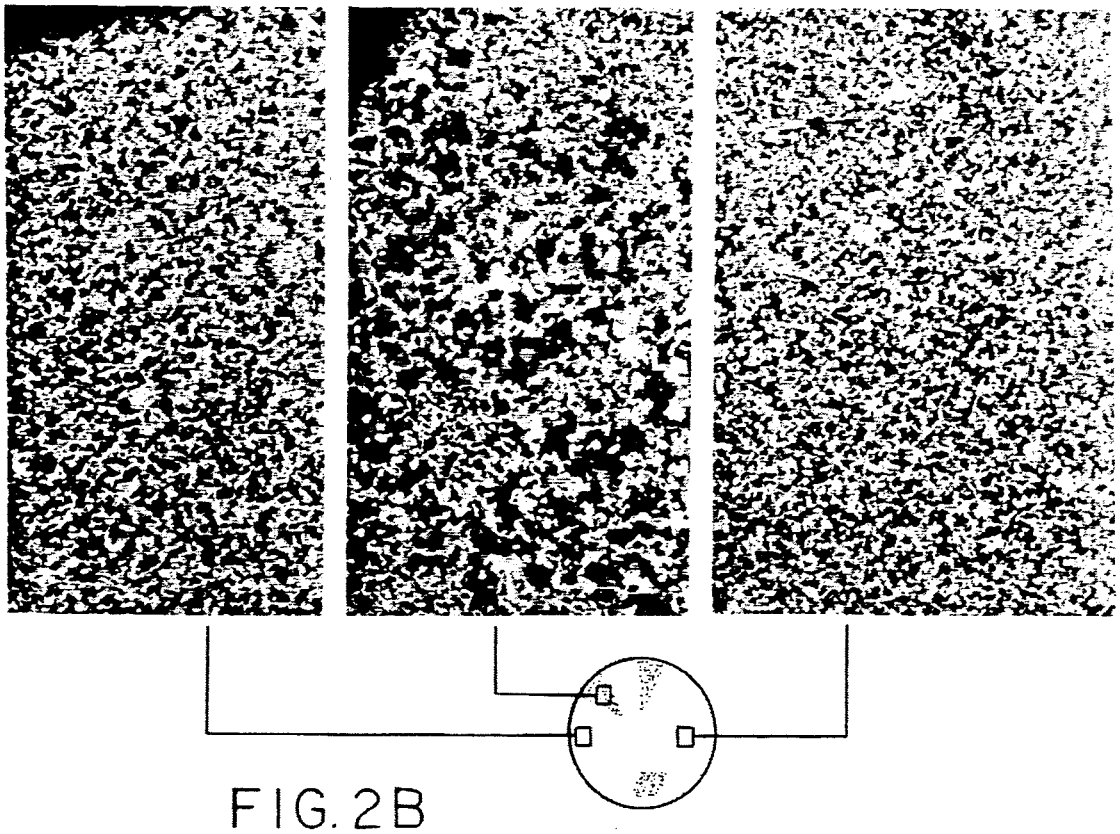
Figure 4:
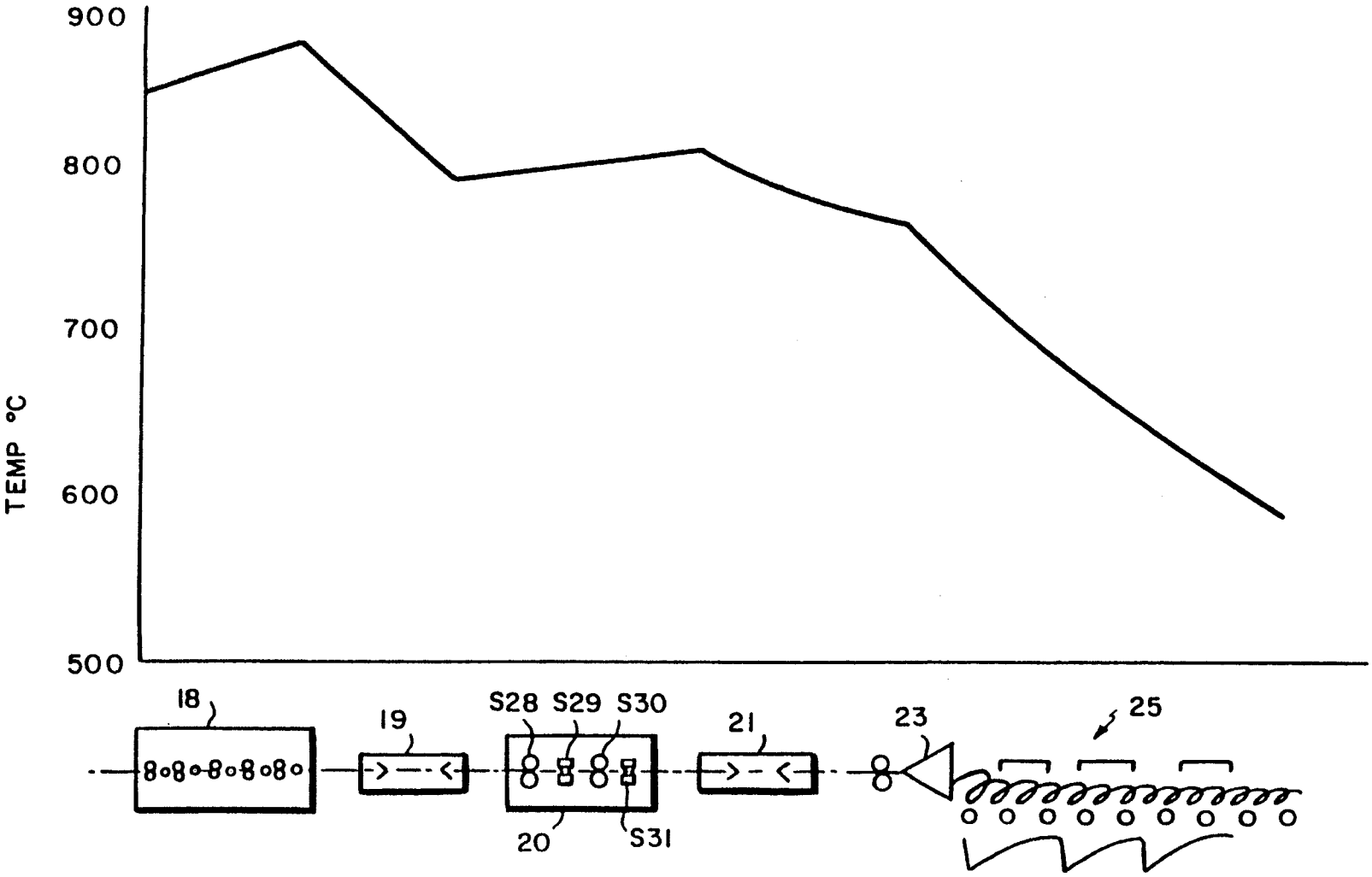
FIG. 4 is graph depicting bulk temperature variations as a product is processed through the finishing end of a diagrammatically illustrated mill incorporating a post finishing block according to the present invention.

With reference to FIGS. 3 and 4, the present invention entails the positioning of a post finishing block 20 downstream of the block 18 typically found in a conventional rod mill installation. The post finishing block includes at least two heavy reduction roll stands S28, S29 preferably providing an oval-round pass sequence, followed by additional lighter reduction sizing roll stands S30, S31 providing a round-round pass sequence.

With particular reference to FIG. 4, it will be seen that one or more water boxes or other like cooling devices 19 are preferably interposed between the blocks 18 and 20. One or more additional water boxes 21 are located between the block 20 and a downstream laying head 23. The laying head forms the rod into a series of rings which are received on a cooling conveyor 25 where they are subjected to additional controlled cooling. The plot line on the graph of FIG. 4 depicts changes in bulk temperature of the product being processed. As herein employed, the term "bulk temperature" means the average cross-sectional temperature between the surface and core of the product.

Figure 5:
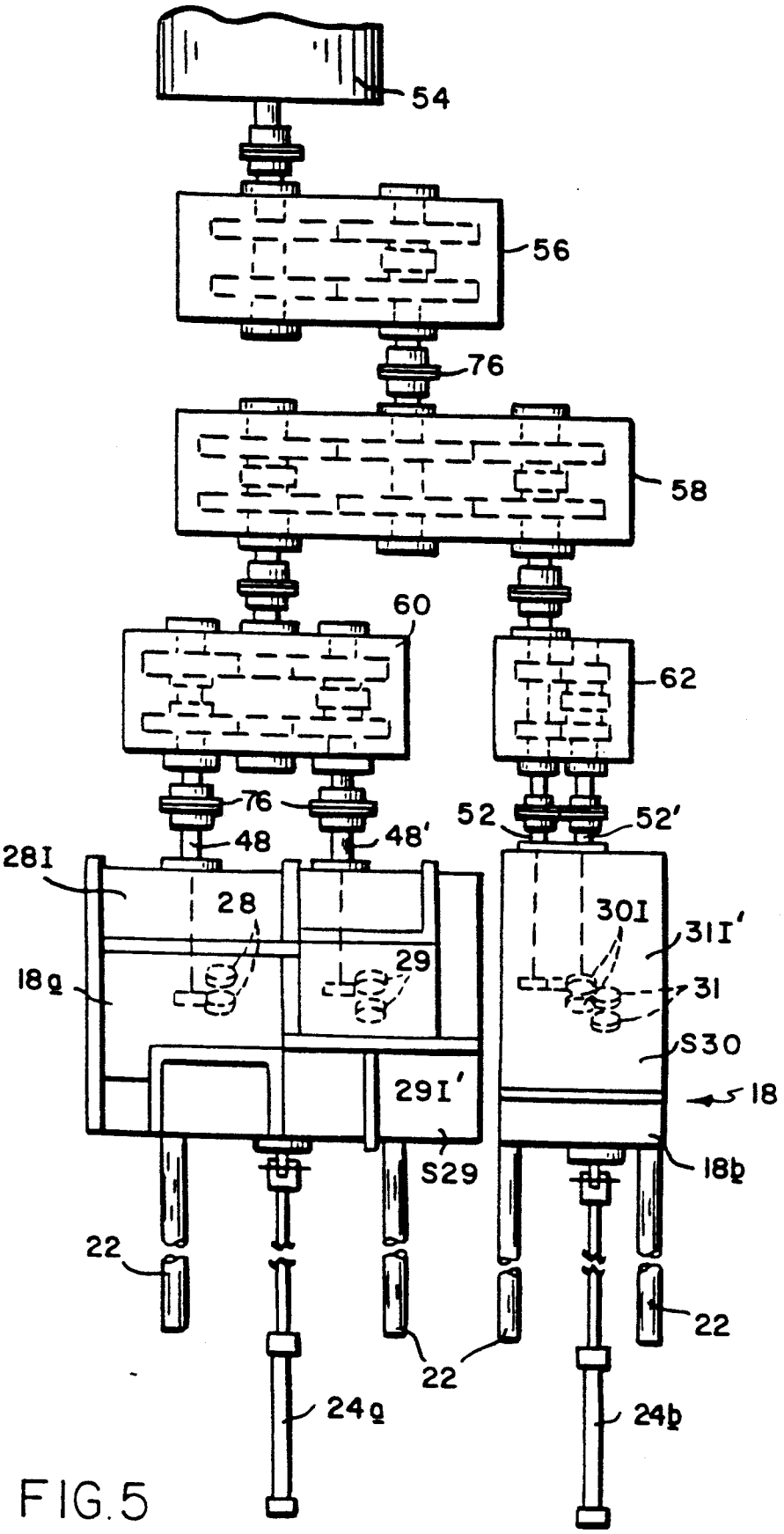
FIG. 5 is a plan view of a post finishing block and its associated drive components in accordance with the present invention.

Referring additionally to FIG. 5, it will be seen that roll stands S28 and S29 may be contained in a reduction mill section 18*a* which is mounted on tracks 22 for movement onto and off of the rolling line by means of a linear actuator 24*a*. Similarly, the roll stands S30, S31 may be contained in a sizing mill section 18*b* mounted on tracks 22 and shiftable by another linear actuator 24*b*. The successive roll stands S28–S31 are respectively provided with pairs of grooved work rolls 28, 29, 30 and 31.

Figure 6:
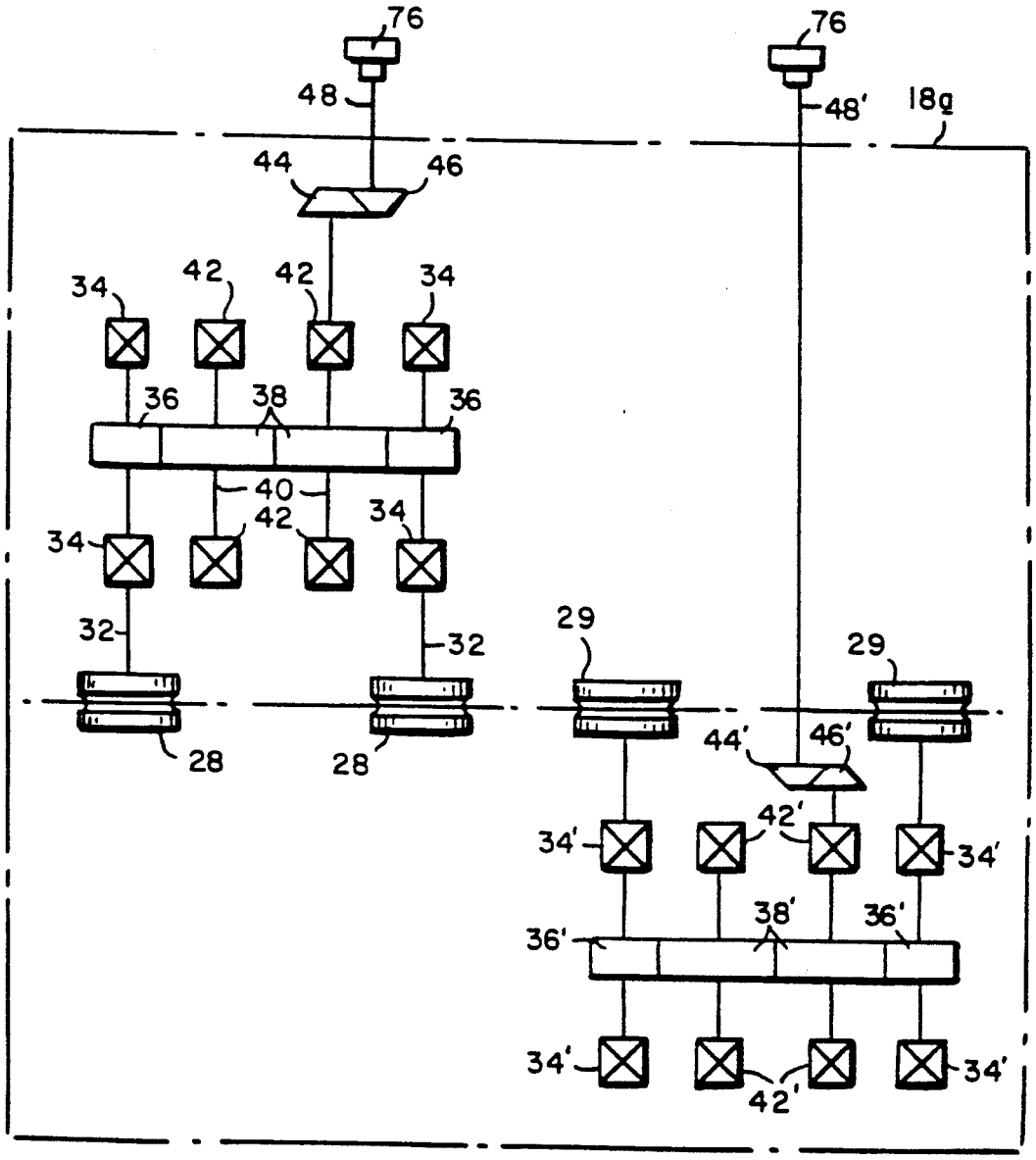
FIG. 6 is a diagrammatic illustration of the internal drive arrangement for stands S28 and S29 of the post finishing block.

As can be best seen in FIG. 6, the work rolls 28 of roll stand S28 are mounted in cantilever fashion on the ends of roll shafts 32. The roll shafts 32 are journalled for rotation between bearings 34. Gears 36 on the roll shafts 32 mesh with intermeshed intermediate drive gears 38, the latter being carried on intermediate drive shafts 40 also journalled for rotation between bearings 42. One of the intermediate drive shafts is additionally provided with a bevel gear 44 meshing with a bevel gear 46 on an input shaft 48. The bevel gears 44, 46 accommodate the inclination of the work roll shafts. Although not shown, it will be understood that means are provided for adjusting the parting between the work rolls.

The work rolls 29 of roll stand S29 are driven in a like manner by components identified by the same "primed" reference numerals. Although not shown, it will be understood that the sizing roll stands S30 and S31 are similarly configured with like internal components arranged to drive their respective work roll pairs 30, 31 via input shafts 52, 52'.

Figure 7:
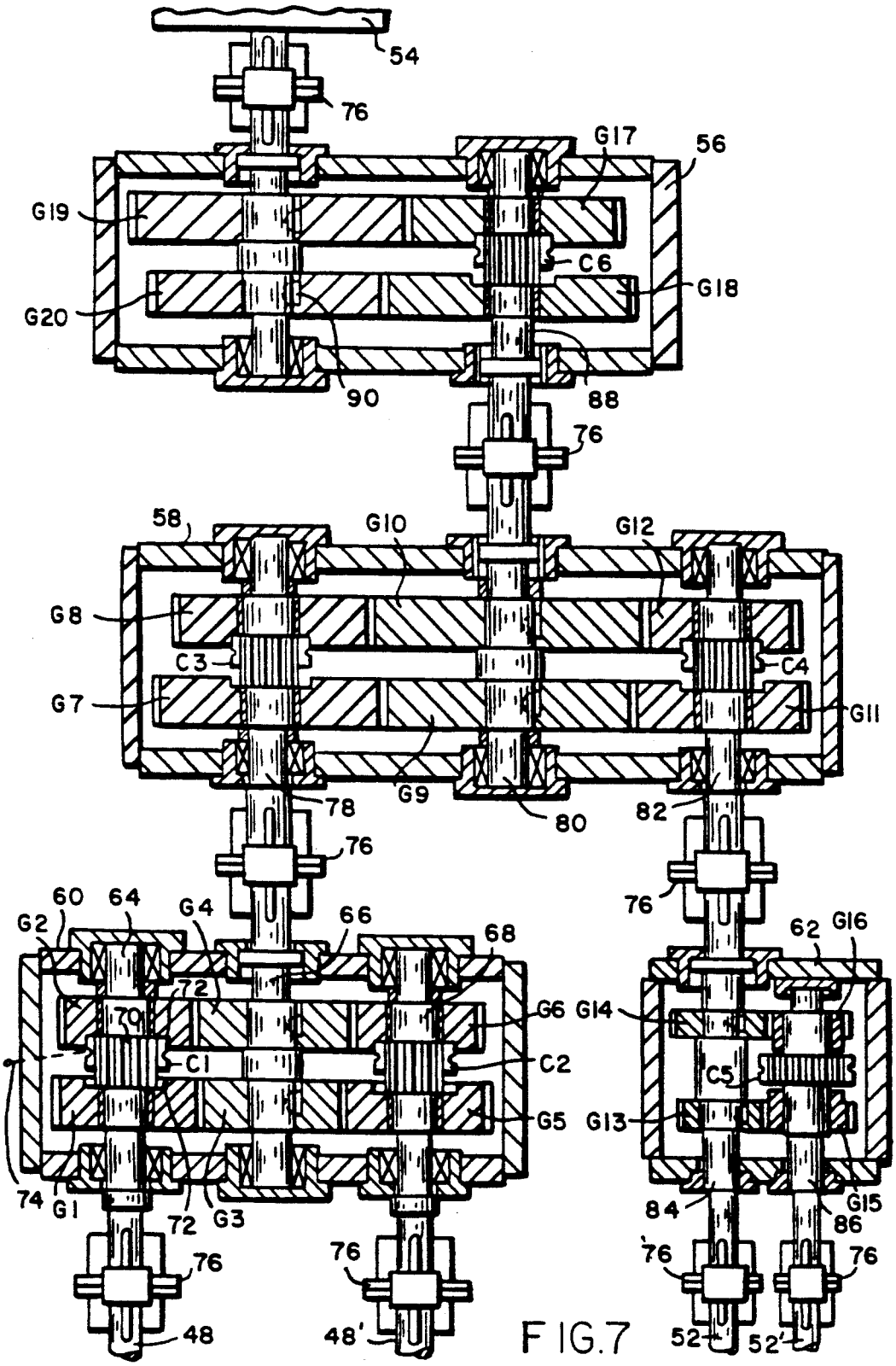
FIG. 7 is a diagrammatic illustration of the external drive arrangement for stands S28 to S31 of the post finishing block.

The roll stands S28–S31 are mechanically interconnected to each other and to a common drive motor 54 by a series of gear boxes 56–62 As can best be seen in FIG. 7, gear box 60 has three parallel rotatable shafts 64, 66 and 68. Shaft 64 supports two freely rotatable gears G1, G2 axially separated by an enlarged intermediate shaft section 70. The confronting faces of gears G1, G2 are recessed as at 72 to accommodate internal teeth adapted to be alternatively engaged by the external teeth of a clutch element C1. Clutch element C1 is rotatably fixed by keys, splines or the like (not shown) to the enlarged diameter shaft section 70, and is axially shiftable by means of a fork 74 or the like between one of two operative positions at which its external teeth are engaged with one or the other of the internal teeth of the gears G1, G2.

The gears G1, G2 have external teeth meshing with gears G3, G4 keyed or otherwise fixed to shaft 66 for rotation therewith. Gears G3, G4 also mesh with gears G5, G6 freely rotatable on shaft 68. Gears G5, G6 are also axially separated by an enlarged diameter shaft section. An axially shiftable clutch element C2 serves to rotably engage the shaft 68 to one or the other of gears G5, G6.

The shafts 64, 68 are adapted for connection to the input shafts 48, 48' of roll stands S28, S29 via couplings 76. Similarly, shaft 66 is connected to shaft 78 of gear box 58 via a coupling 76.

Gear box 58 includes components similar to those contained in gear box 60. Thus, gear box 58 has parallel shafts 78, 80 and 82. Shafts 78 and 82 respectively carry axially spaced freely rotatable gears G7, G8 and G11, G12 which mesh with gears G9, G10 rotatably fixed to shaft 80. A clutch element C3 alternatively establishes a driving relationship between shaft 78 and one or the other of gears G7, G8. A clutch element C4 likewise establishes an alternative drive connection between shaft 82 and gears G11, G12.

Shaft 82 is connected via a coupling 76 to shaft 84 of gear box 62. Gears G13, G14 are rotatably fixed to shaft 84 and mesh respectively with freely rotatable gears G15, G16 on shaft 86. Gears G15, G16 are alternatively engaged to shaft 86 by means of an axially shiftable clutch element C5. Shafts 84, 86 are adapted for connection to the input shafts 52, 52' of roll stands S30, S31 via couplings 76.

Shaft 80 of gear box 58 is connected to shaft 88 of gear box 56 via coupling 76. Here again, shaft 88 carries freely rotatable gears G17, G18 alternatively engagable with shaft 88 by means of an axially shiftable clutch element C6. The gears G17, G18 mesh with gears G19, G20 rotatably fixed to shaft 90, the latter being connected via coupling 76 to the output shaft of motor 54.

With the above-described gearing and clutching arrangement, different drive sequences and associated interstand speed ratios can be developed to obtain a wide range of reductions in the roll passes of stands S28 to S31. Table 1 is illustrative although by no means exhaustive of various possible drive sequences.

TABLE I

| DRIVE SEQUENCE | CLUTCH/GEAR ENGAGEMENT C1 | C2 | C3 | C4 | C5 |
|---|---|---|---|---|---|
| A | G1 | G6 | G8 | G11 | G15 |
| B | G2 | G6 | G8 | G12 | G15 |
| C | G1 | G5 | G7 | G11 | G15 |
| D | G2 | G5 | G7 | G12 | G16 |
| E | G1 | G6 | G8 | G11 | G16 |
| F | G2 | G6 | G8 | G12 | G16 |
| G | G1 | G5 | G7 | G11 | G16 |
| H | G2 | G5 | G7 | G12 | G15 |

Assume that the finishing stands of block 18 are fed with a first process section having a diameter of 18.2 mm. Assume further that the rolling schedule of the finishing stands S20–S27 is designed to produce the sequence of reductions shown in Table II.

TABLE II

| Stand | % Area Reduction | Shape or Diameter (mm) |
|---|---|---|
| S20 | 23 | OVAL |
| S21 | 16 | 14.6 |
| S22 | 23 | OVAL |
| S23 | 16 | 11.7 |
| S24 | 23 | OVAL |
| S25 | 19 | 9.5 |
| S26 | 22 | OVAL |
| S27 | 18 | 7.5 |

By selecting from the drive sequences of Table I, and by selectively rolling through and/or dummying the finishing stands of block 18 to feed the post finishing block 20 with different sized second process sections, it is possible to achieve reductions and finished product sizes of the type tabulated by way of example in Table III.

TABLE III

| Feed Stand | Diameter (mm) Feed Section | PERCENT AREA REDUCTIONS S28 | S29 | S30 | S31 | Drive Se-quences | Diameter (mm) Finished Section |
|---|---|---|---|---|---|---|---|
| S27 | 7.5 | 24.3 | 22.6 | 5.9 | 2.6 | A | 5.5 |

TABLE III-continued

| Feed Stand | Diameter (mm) Feed Section | PERCENT AREA REDUCTIONS S28 | S29 | S30 | S31 | Drive Se-quences | Diameter (mm) Finished Section |
|---|---|---|---|---|---|---|---|
| | | 21.4 | 18.9 | 6.0 | 2.8 | B | 5.74 |
| | | 17.0 | 13.8 | 7.1 | 3.5 | C | 6.0 |
| | | 12.3 | 9.1 | 4.0 | 1.8 | D | 6.5 |
| S25 | 9.5 | 24.2 | 22.6 | 5.7 | 1.9 | A | 7.0 |
| | | 21.1 | 18.9 | 2.1 | 0.5 | F | 7.5 |
| | | 12.3 | 9.1 | 7.6 | 3.8 | H | 8.0 |
| S23 | 11.7 | 24.2 | 22.6 | 7.2 | 3.1 | A | 8.5 |
| | | 21.1 | 18.9 | 5.7 | 1.9 | B | 9.0 |
| | | 17.2 | 13.8 | 5.8 | 2.0 | C | 9.5 |
| | | 12.3 | 9.1 | 5.9 | 2.6 | H | 10.0 |
| S21 | 14.6 | 24.2 | 22.6 | 8.2 | 4.0 | A | 10.5 |
| | | 24.2 | 22.6 | 2.5 | 0.8 | E | 11.0 |
| | | 21.1 | 18.9 | 2.3 | 0.75 | F | 11.5 |
| | | 17.2 | 13.8 | 3.9 | 1.5 | G | 12.0 |
| | | 12.3 | 9.1 | 5.8 | 2.4 | H | 12.5 |
| S19 | 18.2 | 25.3 | 22.6 | 8.1 | 3.8 | A | 13.0 |
| | | 24.2 | 22.6 | 4.5 | 1.8 | A | 13.5 |
| | | 21.1 | 18.9 | 5.7 | 1.9 | B | 14.0 |
| | | 17.9 | 14.1 | 7.1 | 3.1 | C | 14.5 |
| | | 17.2 | 13.8 | 3.8 | 1.0 | G | 15.0 |
| | | 12.3 | 9.1 | 7.1 | 2.1 | H | 15.5 |

From table III, it will be seen that the combined total area reductions in the round-round pass sequence of the sizing stands S30, S31 are conventionally light, in most cases well below the 14% considered as the minimum for establishing an acceptably uniform grain structure.

TABLE IV

| COMPARISON OF % OF AREA REDUCTIONS FROM TABLE III | | | | | | | | | | |
|---|---|---|---|---|---|---|---|---|---|---|
| S28 A | S29 B | S30 C | S31 D | C + D E | B + C + D F | A + B + C + D G | D/F | E/G | A/G | E/F |
| 24.3 | 22.6 | 5.9 | 2.6 | 8.5 | 31.0 | 55.40 | .08 | 0.15 | .44 | .27 |
| 21.4 | 18.9 | 6.0 | 2.8 | 8.8 | 27.70 | 49.10 | .10 | 0.18 | .44 | .32 |
| 17.0 | 13.8 | 7.1 | 3.5 | 10.6 | 24.40 | 41.40 | .14 | 0.26 | .41 | .43 |
| 12.3 | 9.1 | 4.0 | 1.8 | 5.8 | 14.90 | 27.20 | .12 | 0.21 | .45 | .39 |
| 24.2 | 22.6 | 5.7 | 1.9 | 7.6 | 30.20 | 54.40 | .06 | 0.14 | .44 | .25 |
| 21.1 | 18.9 | 2.1 | 0.5 | 2.6 | 21.50 | 42.60 | .02 | 0.06 | .50 | .12 |
| 12.3 | 9.1 | 7.6 | 3.8 | 11.4 | 20.50 | 32.80 | .19 | 0.35 | .38 | .56 |
| 24.2 | 22.6 | 7.2 | 3.1 | 10.3 | 32.90 | 57.10 | .09 | 0.18 | .42 | .31 |
| 21.1 | 18.9 | 5.7 | 1.9 | 7.6 | 26.50 | 47.60 | .07 | 0.16 | .44 | .29 |
| 17.2 | 13.8 | 5.8 | 2.0 | 7.8 | 21.60 | 38.80 | .09 | 0.20 | .44 | .36 |
| 12.3 | 9.1 | 5.9 | 2.6 | 8.5 | 17.60 | 29.90 | .15 | 0.28 | .41 | .48 |
| 24.2 | 22.6 | 8.2 | 4.0 | 12.2 | 34.80 | 59.00 | .11 | 0.21 | .41 | .35 |
| 24.2 | 22.6 | 2.5 | 0.8 | 3.3 | 25.90 | 50.10 | .03 | 0.07 | .48 | .13 |
| 21.1 | 18.9 | 2.3 | 0.75 | 3.05 | 21.95 | 43.05 | .03 | 0.07 | .49 | .14 |
| 17.2 | 13.8 | 3.9 | 1.5 | 5.4 | 19.20 | 36.40 | .08 | 0.15 | .47 | .28 |
| 12.3 | 9.1 | 5.8 | 2.4 | 8.2 | 17.30 | 29.60 | .14 | 0.28 | .42 | .47 |
| 25.3 | 22.6 | 8.1 | 3.8 | 11.9 | 34.50 | 59.80 | .11 | 0.20 | .42 | .34 |
| 24.2 | 22.6 | 4.5 | 1.8 | 6.3 | 28.90 | 53.10 | .06 | 0.12 | .46 | .22 |
| 21.1 | 18.9 | 5.7 | 1.9 | 7.6 | 26.50 | 47.60 | .07 | 0.16 | .44 | .29 |
| 17.9 | 14.1 | 7.1 | 3.1 | 10.2 | 24.30 | 42.20 | .13 | 0.24 | .42 | .42 |
| 17.2 | 13.8 | 3.8 | 1.0 | 4.8 | 18.60 | 35.80 | .05 | 0.13 | .48 | .26 |
| 12.3 | 9.1 | 7.1 | 2.1 | 9.2 | 18.30 | 30.60 | .11 | 0.30 | .40 | .50 |

However, these are immediately preceded by significantly heavier combined total area reductions on the order of about 20–50% in the oval-round pass sequence of stands S28 and S29. This holds true irrespective of the number of previous stands being dummied by the finishing block 18 in order to achieve progressively larger finished product sizes.

With reference to the reduction comparisons set forth in Table IV, it will be seen that relatively light reductions totalling 3–12% are taken in the round-round passes of stands S30,S31 (Column E). Such light reductions optimize sizing accuracy and also broaden the range of products that can be sized without changing rolls and/or groove configurations.

The light reductions taken in stands S30,S31 are insufficient, by themselves, to establish the elevated internal energy levels needed to avoid the abnormal grain growth which leads to the development of duplex microstructures. However, that energy level is more than adequately established by the significantly heavier reductions which take place in the oval-round passes of the immediately preceding stands S28,S29 (Columns A and B).

In order to ensure that this objective is achieved, the minimum total reduction of about 14% is taken as progressively smaller reductions in the sequential round passes of stands S29, S30, and S31, with the reduction in stand S31 being less than about 20% of the total (Column D/F in Table IV).

Typically, the total reductions taken in the last three stands will range from about 14%-35% (Column F), with less than 50% occurring in stands S30,S31 (Column E/F). The reduction taken in the oval pass of the first stand S28 adds significantly to the overall capacity of the block, elevating total reductions for the four stand series to a range of about 30-60% (Column G). Here, the reduction in the oval pass accounts for at least about 40% of the total (Column A/G), with the last two stands contributing less than about 35% of the total (Column E/G).

It will be seen, therefore, that the combined reductions taken in the oval-round pass sequence of stands S28 and S29 and the round-round pass sequence of stands S30 and S31 produce an increased energy level in the product sufficient to create a substantially uniform distribution of fine grains. This effect can be further enhanced by employing the water box 19 to lower the temperature of the rod prior to its entering the post finishing block 20. The time interval between heavier reduction rolling in stands S28, S29 and lighter reduction sizing in stands S30, S31 is extremely short. For example, with the range of product sizes and reduction sequences shown on Table III, the time interval between rolling in stand S29 and stand S30 is likely to range between about 5 to 25 milliseconds, with rolling through the last three stands S29-S31 taking no more than about 10.4 to 16.0 milliseconds. Thus, sizing is effected well before the development of abnormal grain growth, thereby resulting in finished products having a substantially uniform fine grained microstructure, i.e., a microstructure wherein grain size across the cross-section of the product does not vary by more than 2 ASTM.

Figure 8A:
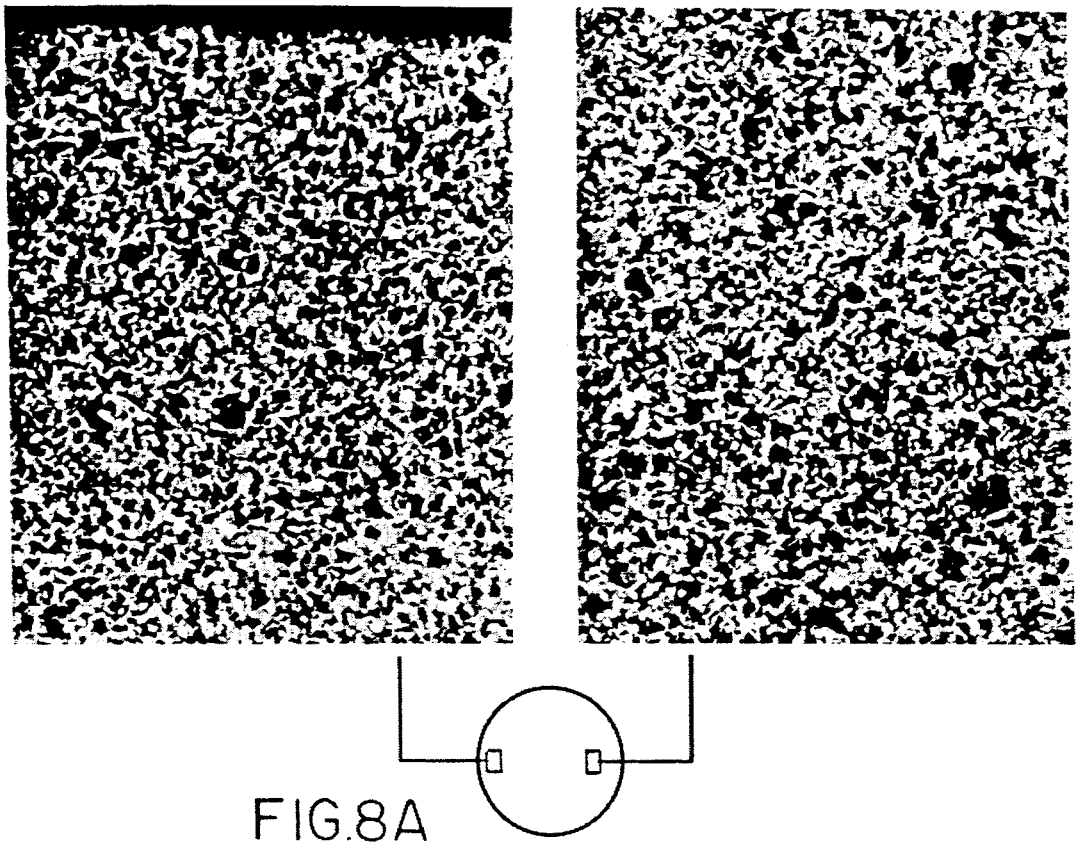
FIGS. 8A and 8B respectively include photomicrographs of a product's grain structure before and after sizing in round/round roll passes affecting reductions high enough to avoid abnormal grain growth.
Figure 8B:
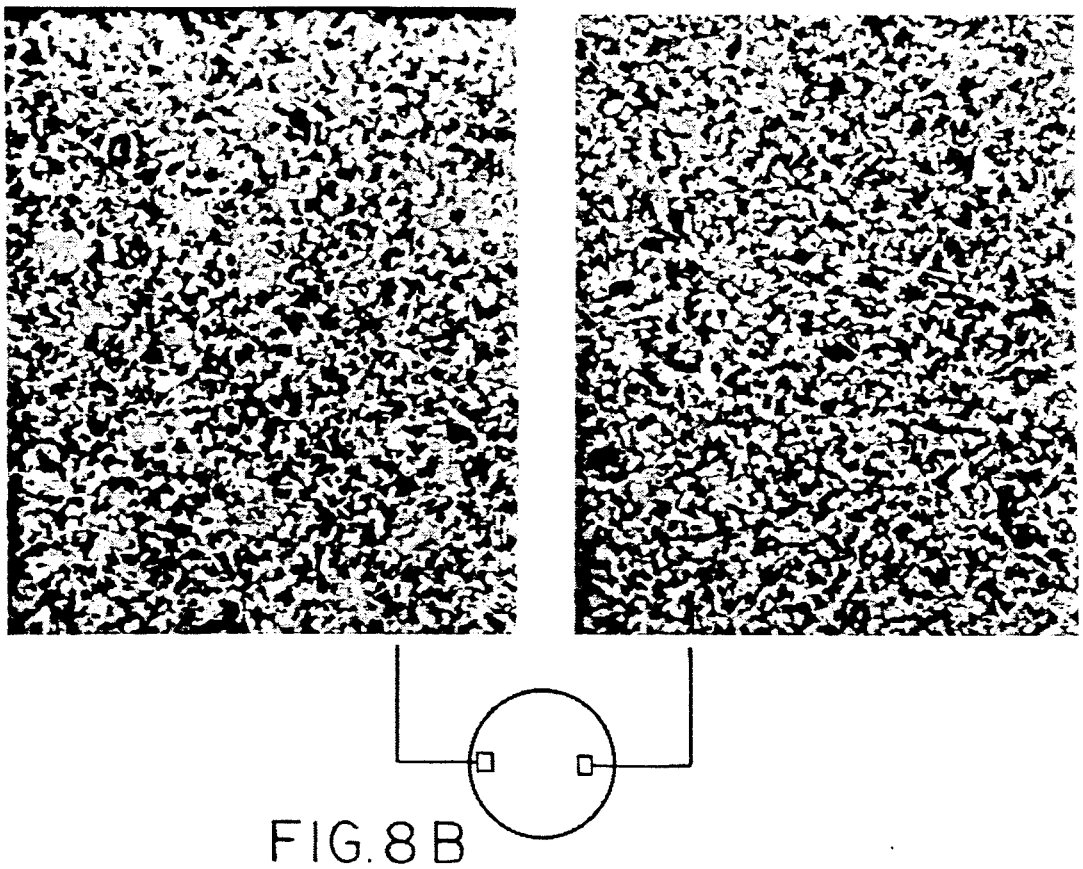

FIGS. 8A and 8B illustrate the benefits of taking larger percentage reductions in conjunction with the sizing operation. FIG. 8A includes photomicrographs (X150) showing the grain structure at selected locations in the cross-section of a 11.0 mm rod, steel grade 1035, prior to sizing. FIG. 8B includes photomicrographs at the same magnification of the same product after it has undergone sizing in a two pass sequence at higher A reduction levels of approximately 16.6%.

The oval-round pass sequence of stands S28 and S29 can accommodate both normal and lower temperature thermomechanical rolling, thus making it possible to size both types of products.

The range of finished product sizes tabulated in Table III is by no means exhaustive. Thus, by dummying stands further back into the intermediate group 14, or by readjusting the rolling schedule in order to feed the finishing group 16 with a smaller process section, the size range of finished products can be expanded to encompass not only smaller sizes on the order of 3.5 mm, but also larger sizes of 25.5 mm and higher. By the same token, the area reduction effected in the oval-round pass sequence of stands S28 and S29 can be expanded to encompass a range of 16-50%.

Although the post finishing block 20 has been shown with cantilevered work rolls, it will be understood that straddle mounted rolls could also be employed.

We claim:

1. A method of continuously hot rolling and sizing long products, comprising:

subjecting the products to progressively diminishing area reductions in a succession of first, second and third mechanically interconnected two roll passes driven by a common mill drive, the said area reductions being achieved by imparting a first cross sectional configuration to the products rolled in said first roll pass, and by imparting a different second cross sectional configuration to the products rolled in each of said second and third roll passes; and selectively adjusting the speeds at which each of said roll passes is driven by said common mill drive in order to change the drive speed ratios between successive roll passes.

2. The method of claim 1 wherein the changes in drive speed ratios between successive roll passes span a range sufficient to accommodate combined area reductions of the products being rolled in said roll passes of about 25-56%, with the area reductions occurring in the first and second of said roll passes totalling more than 20%.

3. The method of claim 1 wherein said first cross sectional configuration is an oval, and wherein said second cross sectional configuration is a round.

4. The method of claim 1 wherein the products are subjected to an additional reduction in a fourth two roll pass driven by said common mill drive, said fourth roll pass also imparting said second cross sectional configuration to the products being rolled therein.

5. The method of claim 2 wherein the area reductions occurring in the first and second of said roll passes ranges from about 21-48%.

6. The method of claim 4 wherein the products are subjected to area reductions totalling 3-12% in said third and fourth roll passes.

7. The method of claim 4 wherein the products are subjected to area reductions in the second, third and fourth roll passes totalling from about 14-35%.

8. The method of claim 7 wherein less than about 50% of the total area reductions occurs in the third and fourth roll passes.

9. The method of claim 4 wherein the products are subjected to area reductions in the first, second, third and fourth roll passes totalling from about 30-60%.

10. The method according to any one of claims 1-9 wherein the time interval between rolling in the first and the last of the mechanically interconnected commonly driven roll passes is such that grain size across the cross-section of the products being rolled does not vary by more than 2 ASTM.

11. Apparatus for continuously hot rolling and sizing long products, comprising:

a succession of first, second and third roll stands, each of said roll stands having a pair of grooved work rolls defining a roll pass aligned along a mill pass line, the first of said roll passes being configured to impart a first cross-sectional configuration to the products being rolled, and the second and third of said roll passes being configured to impart a different second cross-sectional configuration to the products being rolled;

a mill drive;

connecting means for mechanically interconnecting said roll stands to each other and to said mill drive; and adjusting means for selectively adjusting the speeds at which each of said roll stands is driven by said common mill drive to thereby change the drive speed ratios between successive stands.

12. The apparatus as claimed in claim 11 further comprising a fourth two roll pass driven by said common mill drive, said fourth roll pass also being configured to impart said second cross-sectional configuration to the products being rolled therein.

13. The apparatus as claimed in either of claims 11 or 12 wherein said connecting means includes multiple gear sets mechanically interposed between each of said roll stands and said mill drive, and wherein said adjusting means includes clutch mechanisms for selectively combining said gear sets in different combinations.

14. The apparatus as claimed in claim 11 wherein said changes in drive speed ratios span a range sufficient to accommodate combined area reductions in the products being rolled in said roll passes of about 25–56%, with the area reductions occurring in the first and second of said roll passes totalling more than 20%.

15. The apparatus of claim 11 wherein said first cross sectional configuration is an oval, and wherein said second cross sectional configuration is a round.

* * * * *